United States Patent [19]

Bartels et al.

[11] 3,998,014

[45] Dec. 21, 1976

[54] PROTECTIVE EDGE CONFIGURATION FOR STRUCTURAL SHEETING

[75] Inventors: Harold Bartels, Villa Park; Albert F. Kuhr, Elk Grove Village, both of Ill.

[73] Assignee: United States Gypsum Company, Chicago, Ill.

[22] Filed: Oct. 14, 1975

[21] Appl. No.: 621,983

[52] U.S. Cl. ..... 52/100; 52/483; 52/741; 206/321; 206/322

[51] Int. Cl.[2] ..... E04B 1/86

[58] Field of Search ..... 52/98–100, 52/741, 144, 485, 486, 484, 483; 206/321–325, 448, 453, 454

[56] References Cited

UNITED STATES PATENTS

| | | | |
|---|---|---|---|
| 1,270,541 | 6/1918 | Maeller | 52/98 |
| 1,989,289 | 1/1935 | Piazza | 52/144 |
| 2,629,143 | 2/1953 | Spector | 52/656 |
| 2,951,318 | 9/1960 | Sedlak | 52/100 |
| 3,087,577 | 4/1963 | Prestia | 52/144 |
| 3,418,766 | 12/1968 | Jackson | 52/485 |

FOREIGN PATENTS OR APPLICATIONS

| | | | |
|---|---|---|---|
| 1,183,231 | 7/1959 | France | 52/100 |
| 1,019,133 | 1/1953 | France | 52/485 |
| 1,813,913 | 12/1968 | Germany | 52/98 |

*Primary Examiner*—Price C. Faw, Jr.
*Assistant Examiner*—Henry Raduazo
*Attorney, Agent, or Firm*—Donnie Rudd; Samuel Kurlandsky; Robert H. Robinson

[57] ABSTRACT

A structural sheeting unit, such as fiberous ceiling tile, is disclosed comprising a panel kerfed around the edge thereof and having an extended edge portion provided on one side of said kerf, thereby protecting the remaining edge portion from damage during handling, said extended edge portion being weakened along a line corresponding to the remaining edge portion thereby enabling the extended portion to be easily broken away for installation.

10 Claims, 7 Drawing Figures

PROTECTIVE EDGE CONFIGURATION FOR STRUCTURAL SHEETING

BACKGROUND OF THE INVENTION

1. Field of the Invention

This invention relates to kerfed structural sheeting units such as kerfed ceiling tile.

2. Description of the Prior Art

Easily breakable structural sheeting units, such ceiling tiles, can have the edges thereof easily damaged during transport and handling. In the industry, this results in a rather large amount of rejections due to damage. One way of overcoming this problem is to have inverted-T runners for supporting the tile with the runner covering the damaged portion. However, in many instances it is desirable to have a concealed ceiling panel i.e. a panel in which the inverted-T runners do not show. When this type of design is desired, the breakage or damage to the edges becomes significant in that it requires rejection of the entire panel. Prior attempts to overcome this problem have resulted in some type of offsetting of the kerfed edges to protect the visable edge, but such a construction has always limited the use of the ceiling tile and required construction in only one or two limited directions in order to accommodate the design features required to protect the visible edge.

Building panels having breakaway edges are not new. In U.S. Pat. No. 3,488,248, a roofing panel has a portion of the edge capable of being broken away from the remainder thereof in order that the remaining portion of the edge, consisting of an overlay of the actual product, can be overlapped on the corresponding edge of an adjacent panel to provide a decorative surface. The breakaway portion of this panel, however, does not extend past the covering portion and, therefore, will not protect it from a blow being directed against the edge thereof. In British Patent Specification No. 1,079,139 building panels are provided with breakaway portions made from a V-shaped groove, but, again, the extended portion will not serve as a protection against the portion that is remaining after the breakaway section is removed. In British Pat. No. 1,403,193, building units having breakaway sections are provided, but an entire section is broken away and the remaining portion cannot properly be called a kerfed section nor is it protected by the broken away portion since the remaining portion is not recessed. Additionally, these panels require disposal of major parts of the building material when the broken away portion is removed. Likewise, in Italian Pat. No. 534,078, breakaway portions are provided in building panels, but the portion to be broken away does not protect the remaining portion from damage due to a blow on the edge, and the portion is to be broken away merely as a design feature for engaging another similarly situated or corresponding panel. A similar situation exists in Swiss Patent No. 459,516 wherein the removable portion is so far removed from the remaining portion that it affords no protection from edge damage due to a blow being directed at the edge of the panel.

In U.S. Pat. No. 3,686,060, an extention of one, and only one, edge of the panel is provided but it is so weak (made of only wrapping paper) that it affords absolutely no protection against a blow being directed against the edge portion of the wrapping material. In U.S. Pat. No. 3,516,212, edges of a panel are adapted to be broken away, but the portions thereof are not constructed in such a manner as to afford edge protection against a blow being directed against the edge of the panel. Furthermore, the breakable portion is an extension of the decorative surface thereof, thereby constituting removal of an expensive portion of the building product. In U.S. Pat. No. 2,951,318, grooves are used in a building block to enable a portion thereof to be broken away from the block, but the projections provide no protection for the other side of the edge when a blow is directed against the edge of the building block. In U.S. Pat. No. 2,781,657 a similar type design is used, but the breakaway portion provides no protection for the opposing edge when a blow was directed against the edge of the panel of construction. In U.S. Pat. No. 1,809,393, breakaway portions enable the remaining pieces to act as an inlay and fit into kerfed floor material. In this patent, however, the remaining portion is not sought to be protected against visual damage but it is only required that it maintain some sort of structural integrity which will enable it to be forced into the hardwood flooring material. Finally, in U.S. Pat. No. 1,289,492, slots are provided in roofing tile to enable a portion of a tile to be broken away from the remaining portion, but this does not serve the purpose of having the remaining portion extend outward and be protected by the portion to be broken away, and, actually it merely serves as an expedient for construction rather than as a protection against edge damage.

Prior attempts for protecting edges of building panel structures have either been expensive due to removal of large amounts of the building material or else have been inadequate in providing for protection against edge damage. The new and novel design of this invention provides for edge protection of easily damagable building units at a cost which is less than the cost of units normally being rejected due to such damage.

SUMMARY OF THE INVENTION

It is an object of this invention to provide a structural sheeting unit which is protected against edge damage.

It is the further object of this invention to provide a structural unit such as a fibrous ceiling tile which is adaptable to normal construction and which sustains a minimum of edge damage in normal handling.

It is an additional object of this invention to provide a method for providing ceiling tiles which are not subject to edge damage by normal handling of the tile.

The objects of this invention are accomplished by a structural sheeting unit comprising a panel kerfed around the edge thereof and having an extended edge portion provided on one side of said kerf, thereby protecting the remaining edge portion from damage during handling, said extended edge portion being weakened along a line corresponding to the remaining edge portion thereby enabling the extended portion to be easily broken away for installation. In many cases, such as decorative ceiling tile, made generally from wood or mineral fiber, one side of the structural sheeting unit has a decorative surface. In such an embodiment, it is preferred that the extended edge portion be on the side of the edge opposite to the decorative surface. The preferred method for weakening the extended edge to enable it to be broken away is to provide a groove in the extended edge portion extending substantially along the length thereof.

Fibrous ceiling tiles, i.e. generally wood or mineral fiber types, are particularly suitable for adaptation to the design of this invention. The ceiling tiles normally are kerfed around the edge thereof to provide for suspension from inverted-T runners in a concealed system wherein the decorative surfaces mate one against the other concealing the inverted-T runners and the kerfs.

In producing the structural sheeting units of this invention, it is generally preferred to provide the structural sheeting unit with the kerf therein and with the structural sheeting unit having an extended edge and then to weaken the extended edge along a part corresponding to the remaining edge by cutting a groove in the extended edge portion adjacent to the remaining edge portion.

In use, the structural sheeting unit is manufactured and shipped with the extended edge in place. When the installer receives the unit, he easily breaks away the extended edge thereby converting the structural sheeting unit into a rather standard kerfed sheeting unit and then uses the then developed sheeting unit in the normal manner of construction.

Still other objects will readily present themselves to one skilled in the art upon reference to the following specifications, the drawings, and the claims.

BRIEF DESCRIPTION OF THE DRAWINGS

This invention may be more fully described but it is not limited by the attached drawings wherein.

DESCRIPTION OF THE PREFERRED EMBODIMENTS

Figure 1:
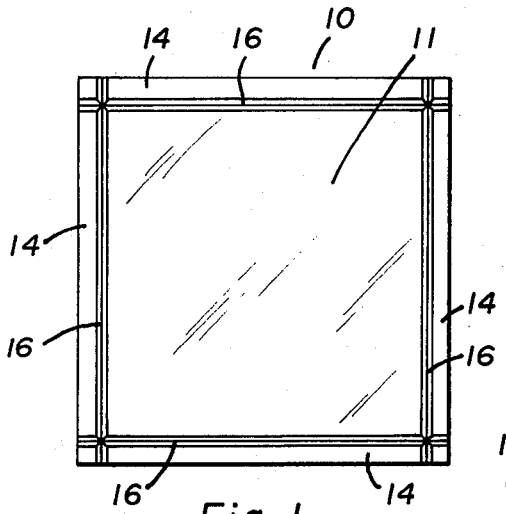
FIG. 1 is a back view of the structural sheeting unit of this invention.
Figure 2:
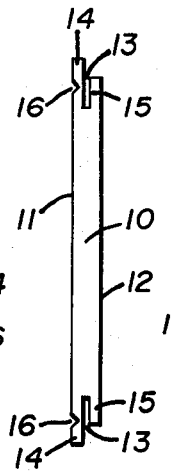
FIG. 2 is an end view of the structural sheeting unit of this invention showing the extended edges before being broken away.
Figure 3:
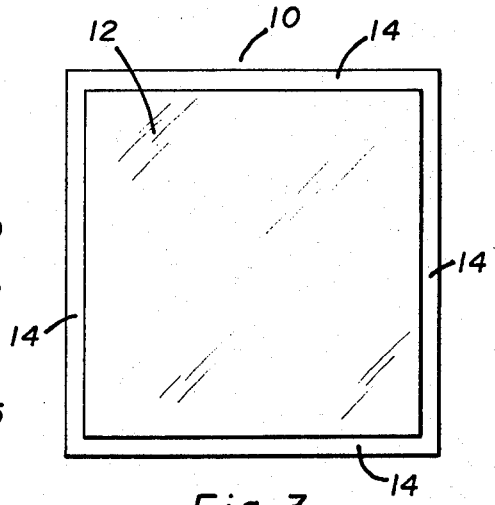
FIG. 3 is a front view of the structural sheeting unit of this invention without the extended edges broken away and showing the face that is normally used as a decorative surface when such is desired in the sheeting unit.
Figure 4:
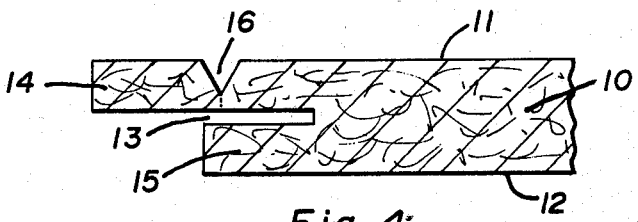
FIG. 4 is an end view of the edge of one embodiment of this invention showing the extended edge having a V-shaped groove in the back of the unit.

In the drawings, referring especially to FIG. 1 – FIG. 3, a structural sheeting unit 10, has a back surface 11 and a front surface 12. The structural sheeting unit has a kerf 13 running entirely around the edge of the structural unit. The kerf separates the edge into two portions. One portion, an extended edge portion 14, extends beyond the remaining edge portion 15 thereby protecting the remaining edge portion from damage in handling. In other words, if a blow is sustained to the edge portion of the structural sheeting unit, the extended edge portion will take the force of the blow requiring the blow to be sufficient to completely penetrate the extended edge portion before it can damage the remaining edge portion. Generally, the blows encountered by such structural units during handling and transport are not sufficient to penetrate the extended edge portion to the extent necessary to damage the remaining edge portion. The extended edge portion is weakened at a point roughly corresponding to the edge of the remaining edge portion in order that the edges will be somewhat uniform after the extended edge portion is broken away. In most instances, it is desirable to have the extended edge portion break away from the remaining portion at a point interior to the remaining edge portion in order that it will readily accommodate an inverted-T runner in a concealed system and in order that rough edges caused by the breaking away do not extend beyond the edge thereby causing a barrier to smooth construction. While the extended edge portion may be on either a decorated surface or non-decorated surface, it is highly preferable to have it on the non-decorated side of the panel since, here again, any lack of uniformity in breaking away of the extended portion will not prevent a problem.

Figure 5:
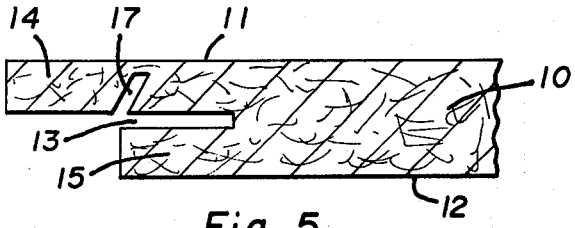
FIG. 5 is an end view of the edge of the structural sheeting unit of this invention showing the groove and the front side of the extended edge of the structural sheeting unit.
Figure 6:
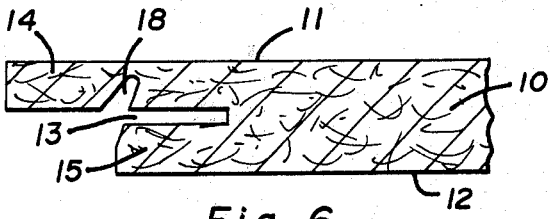
FIG. 6 is an end view of the edge of the structural sheeting of this invention showing another design of the groove.
Figure 7:
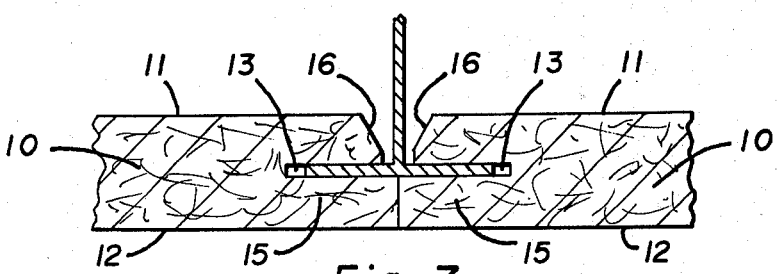
FIG. 7 is an end view of an installed ceiling tile made from the sheeting units of this invention showing the extended edges broken away and showing a supporting inverted-T runner in place.

The extended portion may be weakened by any of several different embodiments. In FIG. 1, FIG. 2, FIG. 4, and FIG. 7, the weakening is provided by a V-shaped groove 16. In FIG. 5, the weakening is provided by a somewhat square groove 17 offset at an angle away from the remaining edge, and in FIG. 6, the weakening is provided by a kerf groove 18, again enabling an offset of the portion remaining after the extended edge is broken away.

In providing the structural unit of this invention, it is preferable to provide first the structural sheeting unit with the kerf therein and with the extended edge portion and then weakening the extended edge portion at the proper position by a groove or some other such cut therein.

While only several forms and embodiments of the invention have been shown and described, other forms and embodiments within the spirit and scope of the invention will become apparent to those skilled in the art. Therefore, the forms and embodiments shown in the drawings are to be considered as merely setting forth the invention for illustrative purposes and are not intended to limit the scope of the invention herein described and shown.

It may thus be seen that the new and novel design of this invention provides a structural sheeting unit which prevents damage to a decorative surface of the structural unit from blows inflicted to the edge of the unit during normal transport and handling. No prior known designs have accomplished such a simple solution in overcoming large amounts of damaged products in the industry. The unique and simple design of this invention is a significant advance to the building industry and provides a simple, although significant, solution to an extremely serious problem which has not been heretofore overcome by any known design.

Having fully described this new and unique invention, the following is claimed:

1. A fibrous ceiling tile comprising a panel with an edge on the outside perimeter thereof, said panel kerfed around the edge thereof and having an extended edge portion provided on one side of said kerf, thereby protecting the remaining edge portion from damage during handling, said extended edge portion being weakened along a line corresponding to the remaining edge portion thereby enabling the extended portion to be easily broken away for installation.

2. A fibrous ceiling tile as in claim 1 wherein one side of the panel has a decorative surface.

3. A fibrous ceiling tile as in claim 2 wherein the extended edge portion is on the side of the edge opposite to the decorative surface.

4. A fibrous ceiling tile as in claim 1 wherein the extended edge portion is weakened by a groove cut therein and extending substantially along the length thereof.

5. A fibrous ceiling tile as in claim 4 wherein the groove is V-shaped.

6. A wood fiber ceiling tile having a front decorative surface, a back surface, and an edge extending around the perimeter thereof, and having a kerf extending around the edge thereof, said ceiling tile having extended edge portions on one side of the kerf, thereby protecting the remaining edge portion from damage during handling, and said extended edge portion weakened along a line correspondng to the remaining edge portion thereby enabling the extended portion to be easily broken away for installation.

7. A wood fiber ceiling tile as in claim 6 wherein the extended edge portion is on the side of the edge opposite to the decorative surface.

8. A wood fiber ceiling tile as in claim 6 wherein the extended edge portion is weakened by a groove cut therein and extending substantially along the length thereof.

9. A wood fiber ceiling tile as in claim 8 wherein the groove is V-shaped.

10. A method for making a structural sheeting unit, said method comprising preparing a fibrous panel with an edge extending around the perimeter thereof, with a kerf in the edge thereof and with the edge on one side of the kerf extending beyond the remaining edge portion, and weakening the extended edge portion to enable it to be easily broken away, whereby the extended edge portion protects the remaining edge portion during handling.

* * * * *